United States Patent [19]

Herlan

[11] 4,215,608

[45] Aug. 5, 1980

[54] PUNCH STRIPPER

[75] Inventor: Alton G. Herlan, Amherst, N.Y.

[73] Assignee: Pivot Punch Corporation, Lockport, N.Y.

[21] Appl. No.: 956,920

[22] Filed: Nov. 2, 1978

[51] Int. Cl.[2] ..... B26F 1/14

[52] U.S. Cl. ..... 83/139; 83/143

[58] Field of Search ..... 83/138, 139, 143

[56] References Cited

U.S. PATENT DOCUMENTS

| | | | |
|---|---|---|---|
| 2,230,043 | 1/1941 | Moran | 83/138 |
| 3,485,122 | 12/1969 | Achler et al. | 83/139 |
| 3,690,205 | 9/1972 | Brown | 83/139 |
| 4,041,817 | 8/1977 | Nelson | 83/139 |

*Primary Examiner*—J. M. Meister

*Attorney, Agent, or Firm*—Bean, Kauffman & Bean

[57] ABSTRACT

The punch stripper of the invention prevents dimpling distortion of thin workpieces and permits punching operations close to the edge of a workpiece, or close to a surface discontinuity such as a rib, while avoiding damage to the stripper. The stripper includes a resilient stripper cap profiled to narrow in the direction of the workpiece with a spherical end surface being preferred.

7 Claims, 7 Drawing Figures

PUNCH STRIPPER

TECHNICAL FIELD OF THE INVENTION

The present invention relates to punching presses and strippers therefor. More specifically, the present invention relates to an elastomeric stripper which is pressed against and expels a workpiece from the piercing nib of a punch.

BACKGROUND OF THE INVENTION

Punching, piercing, perforating, stamping and broaching are conventional mechanical operations in which a punch, die punch or other penetrating member passes into a workpiece. Upon withdrawal of the piercing member, more often than not there is a tendency for the workpiece to adhere to the forming machine element. This tendency has been known to dimple or otherwise warp or distort the workpiece, especially if the workpiece is of thin gauge. Accordingly, it has been conventional to provide stripping devices such as metallic helical or elastomeric spring members with flat caps or stripper plates in association with the punch to push the workpiece off of the punch nib as the punch is withdrawn therefrom.

The designs of conventional prior art strippers have had their drawbacks, however. Stripper plates must be specially designed and machined for each particular job resulting in excessive cost and inflexibility from the point of view of modification once the job has been set up and the stripper plate machined. A further difficulty with stripper plates is that the cross sectional shape of the punch and observance of manufacturing tolerances may preclude fabrication of the plate with a punch passage of the same shape and size as the punch so that the stripper plate does not provide stripping pressure to the workpiece immediately adjacent to all sides of the punch. For thin workpieces, this may result in an undesireable slightly raised burr or dimple distortion when the workpiece is stripped from the punch.

On the other hand, these and other difficulties with the use of stripper plates have been surmounted by elastomeric spring members with ends surrounding each punch as exemplified in U.S. Pat. No. 2,805,717 and especially in U.S. Pat. No. 3,690,205. Such elastomeric strippers, however, are not suitable for punching operations close to an edge of the workpiece or close to a surface discontinuity such as a rib or groove. In such an application, the elastomeric ends are subject to uneven deformation, stress concentration, and failure when repeatedly pressed against the edge or discontinuity. Furthermore, while the punch passage through the elastomeric ends may be made of closely conform to even the most complex punch cross-sections by actually punching the passage through the elastomeric material during an initial operation, the stripping pressure is distributed across the entire flat face of the stripper in such a manner that the stripping pressure immediately adjacent to the punch nib is somewhat less than the pressure exerted by the elastomeric spring member itself so that it may be seen that the stripping pressure exerted by the elastomeric stripper increases slightly in all directions away from the punch.

THE INVENTION

These and other deficiencies and difficulties encountered by the prior art elastomeric and metallic spring strippers are overcome by the stripper of the present invention, which invention includes a resilient stripping member surrounding a punch and an end mounted stripper cap profiled to taper or narrow in toward the punch in the direction of the direction of the workpiece so that the horizontal cross-section of minimum area is encountered closest to the workpiece. With such a configuration, the area of contact between the stripper cap and the workpiece is at a minimum at both first and last moments of contact therebetween so that maximum stripping pressure is exerted by the cap on the workpiece immediately adjacent to the sides of the punch.

In the preferred form, the stripper cap is fabricated of firm yet resilient material to cause the area of contact between the cap and the workpiece to increase slightly as the cap is pressed against the workpiece. This results in the desireable effect of increasing the expulsive force exerted by the stripper and the cap in proportion not only to the degree of compression of the cap but also to the area of contact while assuring that the maximum stripping force remains at the point or points of first contact adjacent to the punch. One such preferred form includes a cap having a hemispherical or substantially hemispherical end surface. Another such form may include a plurality of conical axial sections each of which is formed at a successively smaller angle to the axis of the punch in the direction away from the workpiece. Additionally, a desireable modification of the stripper cap of the present invention includes a recessed portion in the back surface of the stripper cap, said recessed portion having a flat bottom surface which is separated from the exterior tapered surface of the stripper cap by a standard distance. This latter feature permits stripper caps of different sizes to be used on the same job without requiring punch shanks of different lengths.

BRIEF DESCRIPTION OF THE DRAWINGS

The present invention may be better understood and its numerous objects and advantages over the prior art will become apparent to those skilled in the art by reference to the accompanying drawings wherein like reference numerals refer to like elements in the several figures and in which.

DESCRIPTION OF THE BEST KNOWN MODE OF THE INVENTION

Figure 1:
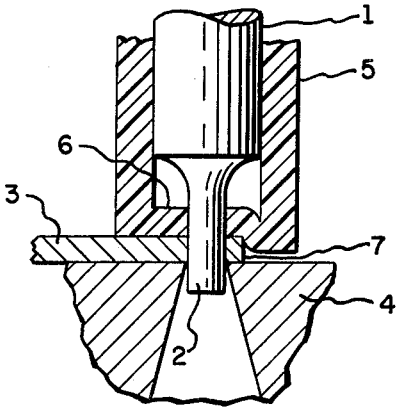
Fig. 1. PRIOR ART
FIGS. 1 and 2 illustrate difficulties encountered by prior art strippers when a workpiece is punched close to an edge thereof or a surface discontinuity respectively.

While the invention is susceptible of various modifications and alternative constructions, there is shown in the drawings and there will hereinafter be described, in detail, a description of the preferred or best known mode of the invention. It is to be understood, however, that the specific description and drawings are not intended to limit the invention to the specific form disclosed. On the contrary, it is intended that the scope of this patent include all modifications and alternative constructions thereof falling within the spirit and scope of the invention as expressed in the appended claims to the full range of their equivalents.

Figure 2:
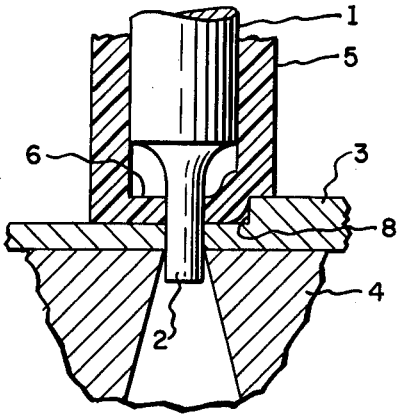
Fig. 2. PRIOR ART

Problems evidenced in the use of the apparatus of the prior art are shown in FIGS. 1 and 2 which illustrate the difficulties encountered when a resilient elastomeric stripper encounters an edge of the workpiece or a surface discontinuity such as a rib or a raised edge. In general, the prior art is illustrated as consisting of a punch having a punch shank 1 with a punch nib 2 punching through a workpiece 3 against a flat die 4. An elastomeric spring 5 is shown engaging the workpiece in its compressed state with the end of the elastomeric spring 5 taking the form of an annular end 6 through which punch nib 2 penetrates. When it is required to punch close to the edge 7 of the workpiece as shown in FIG. 1, the previous prior art elastomeric strippers would be deformed somewhat as shown with the resultant effect that the conventional stripper would fracture after only a few strokes. In a similar manner, when the elastomeric stripper of FIG. 2 encounters a surface discontinuity which is exemplified as an upwardly projecting shoulder 8, the stripper would fail in a similar manner after only a few strokes. The short lifetime of the elastomeric strippers in these as well as other situations has heretofor been unacceptable so that other and more expensive stripping techniques have been required.

Figure 3:
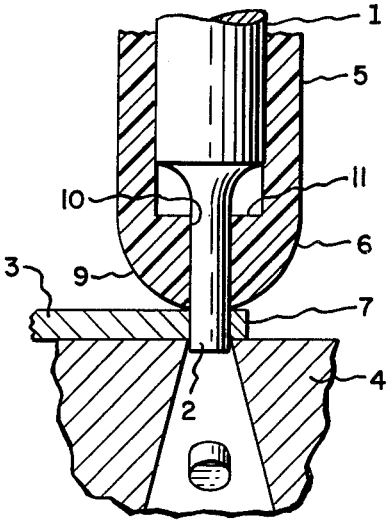
FIGS. 3 and 4 illustrate the operation of the present invention in the two situations shown in FIGS. 1 and 2 and in which the prior art strippers have been known to experience difficulty.
Figure 4:
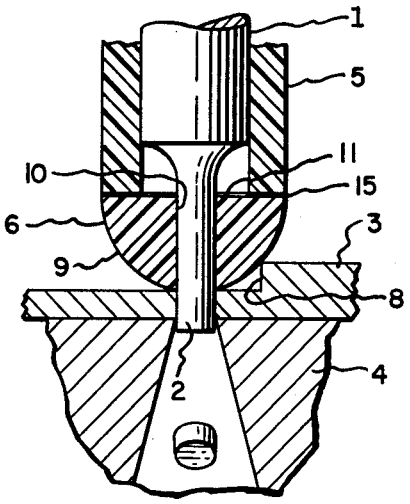

Accordingly, it can be seen that a significant unfulfilled need has been felt by the punch and die industry for a stripper which is able to work effectively in close proximity to the edge of a workpiece or to a surface discontinuity. The present invention fulfills this previously unsatisfied need and is illustrated in FIGS. 3 and 4 to include a resilient spring member 5 having in association therewith a stripper end portion or cap 6 which includes an external surface 9 profiled to taper in toward the punch in the direction of the workpiece 3. While the invention is intended to include integrally formed end portions, as well as separately fabricated end portions or caps which have been adhesively applied to the end of spring member 5, ease of description dictates the use of the characterization "cap" hereafter. The scope of the invention should not be so limited, however. In the preferred form, end cap 6 is hemispherical with its axis of symmetry lying along the longitudinal axis of punch 1 so that the area of contact between the stripper cap 6 and the workpiece 3 is at a minimum at both first and last moments of contact between the cap and the workpiece.

As can be seen from FIG. 3, the spherical or substantially spherical surface 9 of cap 6 permits the stripper to contact workpiece 3 in a limited area in close proximity to punch nib 2 at which point or points the stripping pressure is concentrated. In this manner, the stripper cap of the present invention avoids the problems encountered by the prior art design shown in FIG. 1 to successfully avoid distortion over the edge 7 of workpiece 3 so that large order stress concentrations are not produced and so that many thousands of strokes can be accomplished without stripper failure.

When stripper cap 6 is made from a firm yet resilient material, deformation of cap 6 causes the area of contact and thereby the explusive force between the stripper and the workpiece to increase as the cap is pressed toward the workpiece. Regardless of the degree of compression of resilient spring member 5 and stripper cap 6, the greatest stripping pressure is exerted closest to the punch nib 2 in a manner which is opposite to the performance of the prior art stripping devices shown in FIGS. 1 and 2. This effect is extremely beneficial in that the force distribution exerted on workpiece 3 by the stripper is exactly that which is required to successfully strip workpiece 3 off of the punch nib 2 without producing a dimpling or distortion of the workpiece as the punch is withdrawn.

Figure 6:
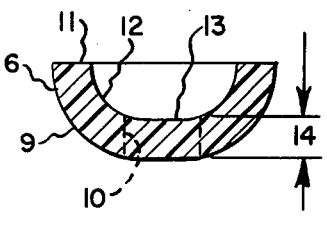
Figure 7:
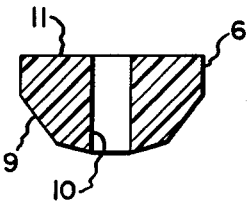

Turning now to FIG. 4, an arrangement similar to that illustrated in FIG. 2 is shown in which the invention is utilized successfully to avoid contact with the surface discontinuity or shoulder 8 of workpiece 3. As will be apparent from this figure, the punching operation can be moved closer to the surface discontinuity as the effective elevation of the discontinuity is decreased in a manner dictated by the cross-sectional profile of stripper cap 6. While a spherical surface 9 has been illustrated, other cross-sectional profiles in which the stripper cap tapers or narrows in the direction of the workpiece are also suitable such as those shown in FIGS. 6 and 7. In FIG. 6 the exterior surface 9 of the illustrated end cap 6 includes a flat central portion surrounded by a surface of revolution created by revolving a 90° arc of a circle around a cylindrical axis of symmetry. FIG. 7 discloses an embodiment in which exterior surface 9 includes a plurality of conical surfaces each of which form a smaller angle with the vertical axis in positions further and further away from the workpiece. While additional examples are not specifically set forth, it should be evident that the scope of the invention also includes such arrangements as ovular, parabolic and hyperbolic surfaces of revolution each of which may find its own desireability for specific applications.

Figure 5:
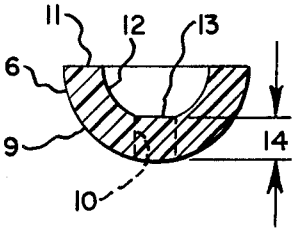
FIGS. 5, 6 and 7 illustrate variations of the theme of the present invention.

Turning now to an examination of FIGS. 5 and 6, it can be seen that in one embodiment of the invention the rear surface 11 of cap 6 is relieved by a depression 12 into which the end of punch nib 2 may penetrate in its rest position between successive punching operations. Depression 12 enables the use of large diameter punches while retaining a minimum overhead clearance within the punching machine itself. Without depression 12, a punch with a broad punch nib 2 would either have to be backed away from the surface of the workpiece by a distance sufficient to permit the hemispherical cap 6 to be inserted between the end of the nib and the workpiece or hemispherical cap 6 would have to be predrilled so that, where closer spacings are desired, the end of the punch nib 2 is permitted to penetrate into the pre-drilled passage. As can be seen in FIGS. 5 and 6, the bottom surface 13 of depression 12 may desireably be formed to be flat and spaced by a standard distance 14 away from the lowermost point of exterior surface 9. This design feature makes it possible to outfit a plurality of different diameter punches with end caps of different sizes without causing each of the punches to be adjusted to be different distances from the workpiece and without causing the lowermost point of each of the end caps 6 to be spaced different distances from the workpiece. Accordingly, when distance 14 is standardized among the various sized caps 6 for the various sized punches, all of the stripper caps 6 can be arranged to contact and break contact with the workpiece at the same moment and all of the punches can be arranged to strike the workpiece at the same moment.

Examination of the figures reveals further additional features which may characterize the invention. First, as shown in FIG. 3, the end cap 6 and the elastomeric spring member 5 may be integral with one another. On the other hand, as shown in FIG. 4, end cap 6 and resilient elastomeric spring 5 may be fabricated as separate pieces and then bonded together by an adhesive 15. This second embodiment has the advantage that the critical characteristics of elastomeric spring 5 and stripper cap 6 may be chosen to be optimum for the specific functions preformed. Accordingly, spring member 5 may have a modulus of elasticity greater than the modulus of elasticity of stripper cap 6 while stripper cap 6 may have a greater durometer hardness than possessed by spring member 5. For example, in a preferred form, spring member 5 may consist of a urethane or polyurethane tube with a durometer hardness of 95A(Shore) while stripper cap 6 may have a durometer hardness of 75D(Shore). In this embodiment adhesives which satisfactorily bond the two urethane materials together are easily found. While urethane or polyurethane materials are preferred, the scope of the present patent should not be interpreted to be limited thereto inasmuch as other materials may be equally as suitable according to the requirements of the user. Therefore, it is possible that cap 6 may consist of nylon or other plastic material while non-plastic substances should not be discounted. Additionally, resilient spring 5 may equally as well be a traditional metallic spring although some of the disadvantages inherent in metallic springs in contrast to elastomeric springs would accompany such an embodiment.

The present invention including an elastomeric stripper cap has the further advantage that the cap may be cast as a solid plastic hemisphere without a passage to accommodate through movement of nib 2 of the punch. Such a solid blank end cap is fixed to the end of a spring member 5 surrounding the shank of the punch so that the punch punches its own passage 10 through the end cap 6 during the first run. This procedure has the advantage that passage 10 is made by the nib itself so that it closely conforms to the cross-sectional profile of the nib in a manner which assures that stripping pressure is applied to the workpiece 3 at all positions immediately adjacent to the periphery of punch nib 2.

What is claimed is:

1. A stripper end portion disposed at the end of a resilient stripper member surrounding a punch for stripping a punched workpiece therefrom subsequent to pressing said workpiece against a flat die so as to prevent distortion of the workpiece at the area immediately surrounding the punch area, characterized in that:

said end portion is profiled to taper in toward the punch in the direction of the workpiece to form a substantially hemispherical external end surface, whereby the area of contact between said stripper end portion and said workpiece is at a minimum at both first and last moments of contact between said end portion and said workpiece and whereby maximum stripping pressure is exerted by said end portion on said workpiece immediately adjacent to said punch.

2. The stripper end portion as recited in claim 1, characterized in that said stripper end portion is provided with a central passage along its axis of symmetry to admit passage of said punch.

3. The stripper end portion as recited in claim 1, characterized in that said stripper end portion has a recessed portion centrally disposed in the flat side of said hemisphere.

4. The stripper end portion as recited in claim 3, characterized in that said stripper end portion includes a flat surface at the bottom of said recessed portion, said flat surface being parallel to said flat side and being spaced from the center point of said spherical surface by a standard distance whereby stripper end portions of different sizes, each having the same standard distance, may be used on the same job without requiring punch shanks of different lengths.

5. An improved composite stripper for stripping a punched workpiece from a punch so as to prevent distortion of the workpiece in the area immediately surrounding the punched area, said stripper including a first elastomeric spring member of a first modulus of elasticity surrounding said punch and a second elastomeric spring member of a second modulus of elasticity less than that of said first member, said second member being fixed to the end of said first member and having a punch passage adapted to permit movement of said punch therethrough, the improvement characterized in that:

said second elastomeric spring member includes a portion which tapers in toward said punch passage to form an end having an inwardly tapered profile having a spherical surface whereby the stripping pressure exerted by said end member is increased as said end member is deformed, whereby the stripping pressure is greatest closest to said punch, and whereby it is able to avoid contact with a surface discontinuity in the workpiece close to the punched area.

6. An improved stripper end portion for a resilient stripper for stripping a punched workpiece from a punch by exerting a stripping force on said workpiece when said resilient stripper is compressed, characterized in that said stripper end portion includes means of generally hemisperical configuration for making initial contact with said workpiece close to said punch while increasing contact therebetween only upon further resilient compression of said stripper.

7. The improved stripper end portion as recited in claim 6 characterized in that said stripper end portion further includes a passage for receiving the piercing end nib of a punch therein along its axis of symmetry.

* * * * *